US006712293B2

(12) United States Patent
Swan

(10) Patent No.: US 6,712,293 B2
(45) Date of Patent: Mar. 30, 2004

(54) NOZZLE TIP FOR AGRICULTURAL SPRAYERS

(75) Inventor: Trevor William Bartlett Swan, Cambridge (GB)

(73) Assignee: Hypro Corporation, New Brighton, MN (US)

( * ) Notice: Subject to any disclaimer, the term of this patent is extended or adjusted under 35 U.S.C. 154(b) by 0 days.

(21) Appl. No.: 10/175,938

(22) Filed: Jun. 20, 2002

(65) Prior Publication Data

US 2003/0234301 A1 Dec. 25, 2003

(51) Int. Cl.[7] ..... B05B 7/06

(52) U.S. Cl. ..... 239/429; 239/419.5; 239/428.5; 239/425.5; 239/424.5; 239/600; 239/568; 239/601

(58) Field of Search ..... 239/419.5, 424.5, 239/425.5, 428.5, 434.5, 429, 270, 335, 552, 554, 568, 597, 600, 601, 550

(56) References Cited

U.S. PATENT DOCUMENTS

| | | | | |
|---|---|---|---|---|
| 4,519,542 A | | 5/1985 | Johnston | |
| 4,527,745 A | | 7/1985 | Butterfield et al. | |
| 4,801,090 A | * | 1/1989 | Yoshida et al. | 239/428.5 |
| 5,125,583 A | | 6/1992 | Strand | |
| 5,190,222 A | * | 3/1993 | Haruch | 239/550 |
| 5,275,340 A | * | 1/1994 | Haruch | 239/550 |
| 5,310,115 A | | 5/1994 | Broyhill | |
| 5,326,036 A | | 7/1994 | Wilger | |
| 5,887,390 A | | 3/1999 | Schulz et al. | |
| 5,927,606 A | | 7/1999 | Patterson | |
| 6,338,444 B1 | | 1/2002 | Swan | |

OTHER PUBLICATIONS

"10 Tips to Get the Most From Your Glyphosate", Dealer & Applicator, May, 2002, pp. 16–18.

* cited by examiner

*Primary Examiner*—Dinh Q. Nguyen
(74) *Attorney, Agent, or Firm*—Thomas J. Nikolai; Nikolai & Mersereau, P.A.

(57) ABSTRACT

Nozzle attached to the boom of agricultural sprayers each include an improved air eduction system and discharge slot eliminating the need to change the angle of the boom and nozzle to ensure a comprehensive spray pattern irrespective of boom height and improved penetration of the material sprayed into and under the crop canopy.

5 Claims, 8 Drawing Sheets

8-8

NOZZLE TIP FOR AGRICULTURAL SPRAYERS

BACKGROUND OF THE INVENTION

I. Field of the Invention

The present invention relates to the application of crop protection chemicals such as fertilizers, herbicides, insecticides, fungicides and the like. More specifically, the present invention relates to nozzle arrangements for fluid spray applicators that ensure fluid is evenly dispersed over a broad area.

II. Description of the Related Art

Most agricultural sprayers are mounted to a motor vehicle. These sprayers typically include one or more tanks in which material to be applied to a farm field is stored, a boom, a plurality of spray nozzles mounted along the boom, plumbing for carrying materials from the tank to the nozzles, and at least one pump for forcing material from the tank, through the plumbing and out the nozzles.

Most boom and nozzle arrangements are designed so that the chemicals are sprayed straight down on the plants. However, recent studies suggest that advantages can be achieved if the boom and nozzles are turned to angle the nozzles back about 10 to 20 degrees. One advantage is that angling the nozzles back ensures some overlap of the spray pattern delivered by adjacent nozzles and, thus, more complete chemical coverage. Another advantage is that angling the nozzles helps the chemical reach weeds that may be hidden underneath the foliage of the crop. For example, if one sprays straight down, the chemical may be blocked by the leaves of soybean plants and never reach the weeds hiding beneath these leaves.

Many boom and nozzle arrangements are designed so that it is either not possible to angle the nozzles back or requires substantial labor or retrofitting to do so. Thus, there is a real need for a nozzle that can be used on a conventional boom and with a traditional nozzle holder for providing all the advantages of angling the boom and nozzles without the labor and expense associated with angling the boom and nozzles.

SUMMARY OF THE INVENTION

The present invention provides a nozzle tip that provides all of the advantages of angling the boom of an agricultural spray system without the cost and labor involved modifying the spray system to angle the boom. The nozzle tip of the present invention can be used with any nozzle cap designed to hold ISO size nozzle tips. The nozzle tip includes an inner member and an outer member which work in combination to generate the desired pattern. The nozzle tip of the present invention uses a unique eduction mixing system and an angled discharge opening to provide all of the benefits without the expense of angling the spray boom.

Other objects and advantages of the present invention will become apparent from the following detailed description of the preferred embodiment in view of the drawings which are described below.

DETAILED DESCRIPTION OF THE PREFERRED EMBODIMENT

Figure 1:
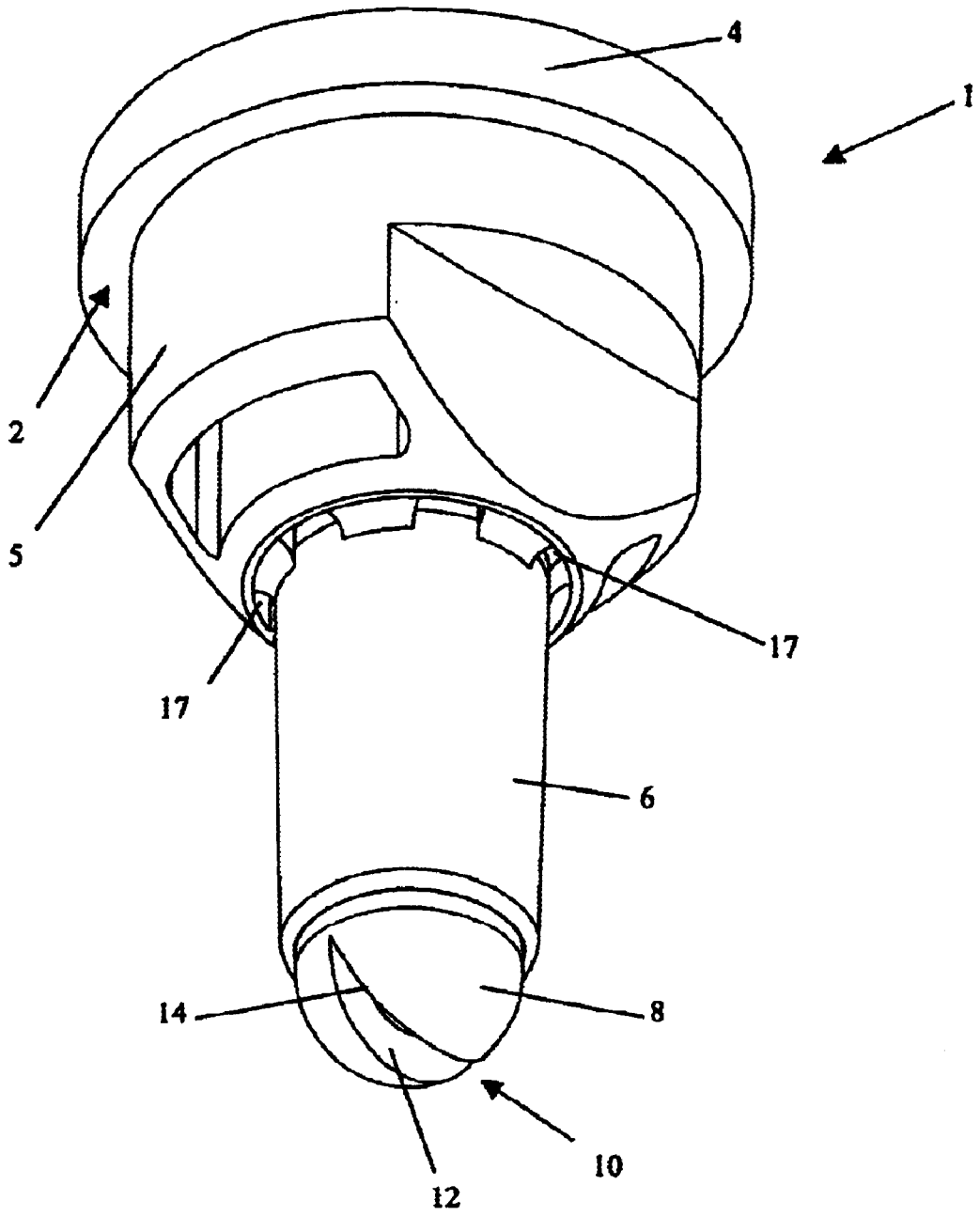
FIG. 1 is a perspective view of the nozzle of the present invention.
Figure 2:
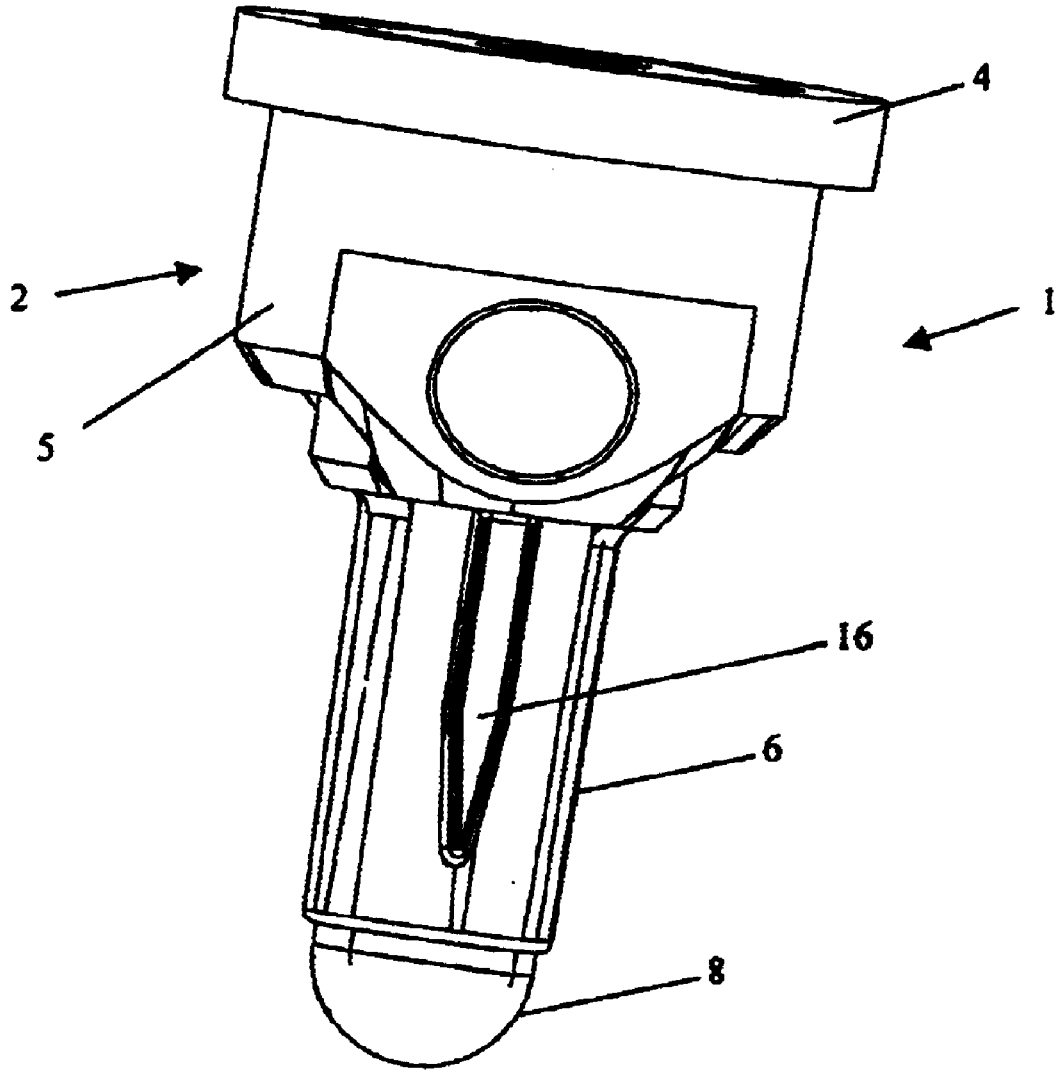
FIG. 2 is a front view of the nozzle of the present invention.
Figure 3:
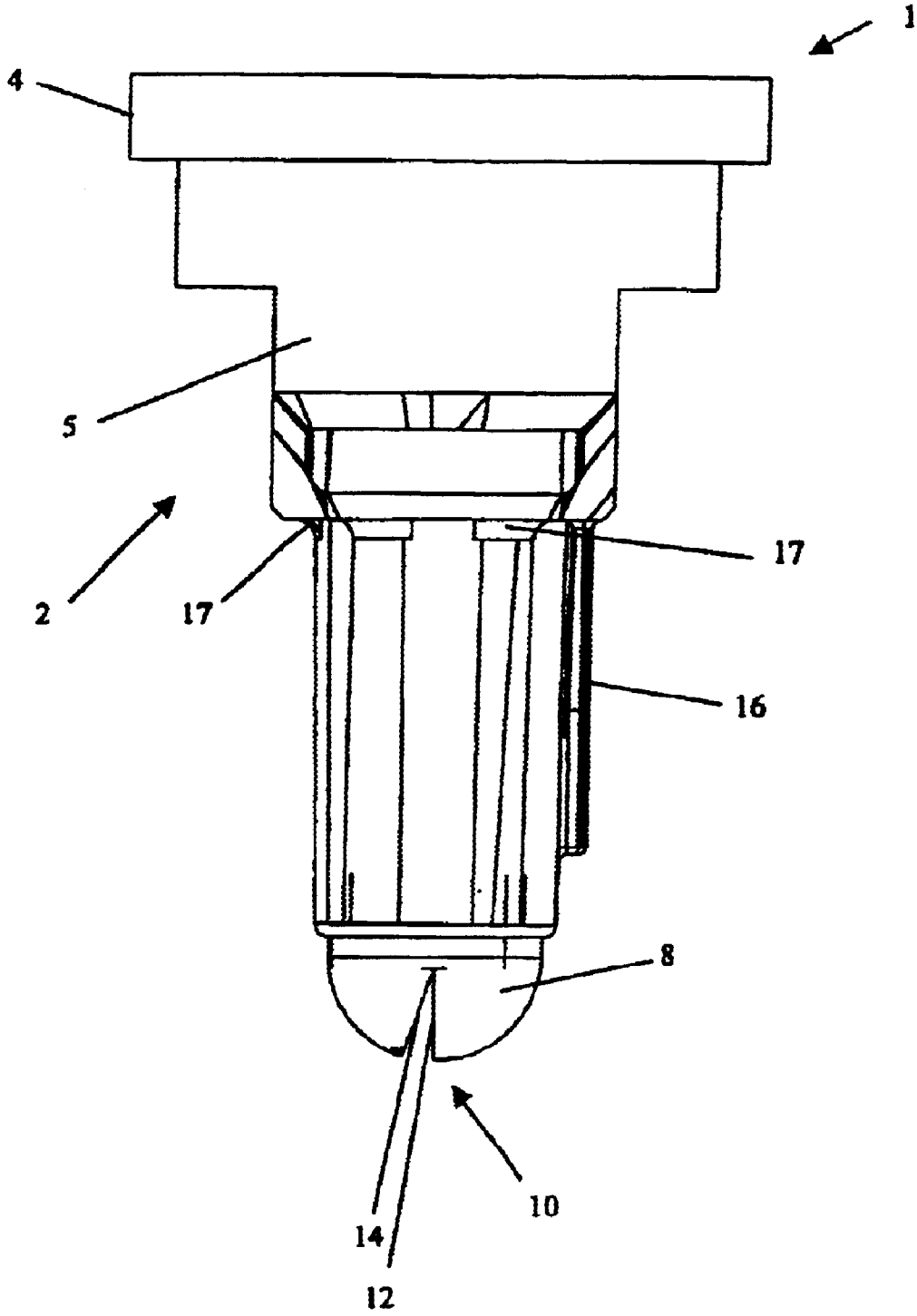
FIG. 3 is a side view of the nozzle of the present invention.
Figure 4:
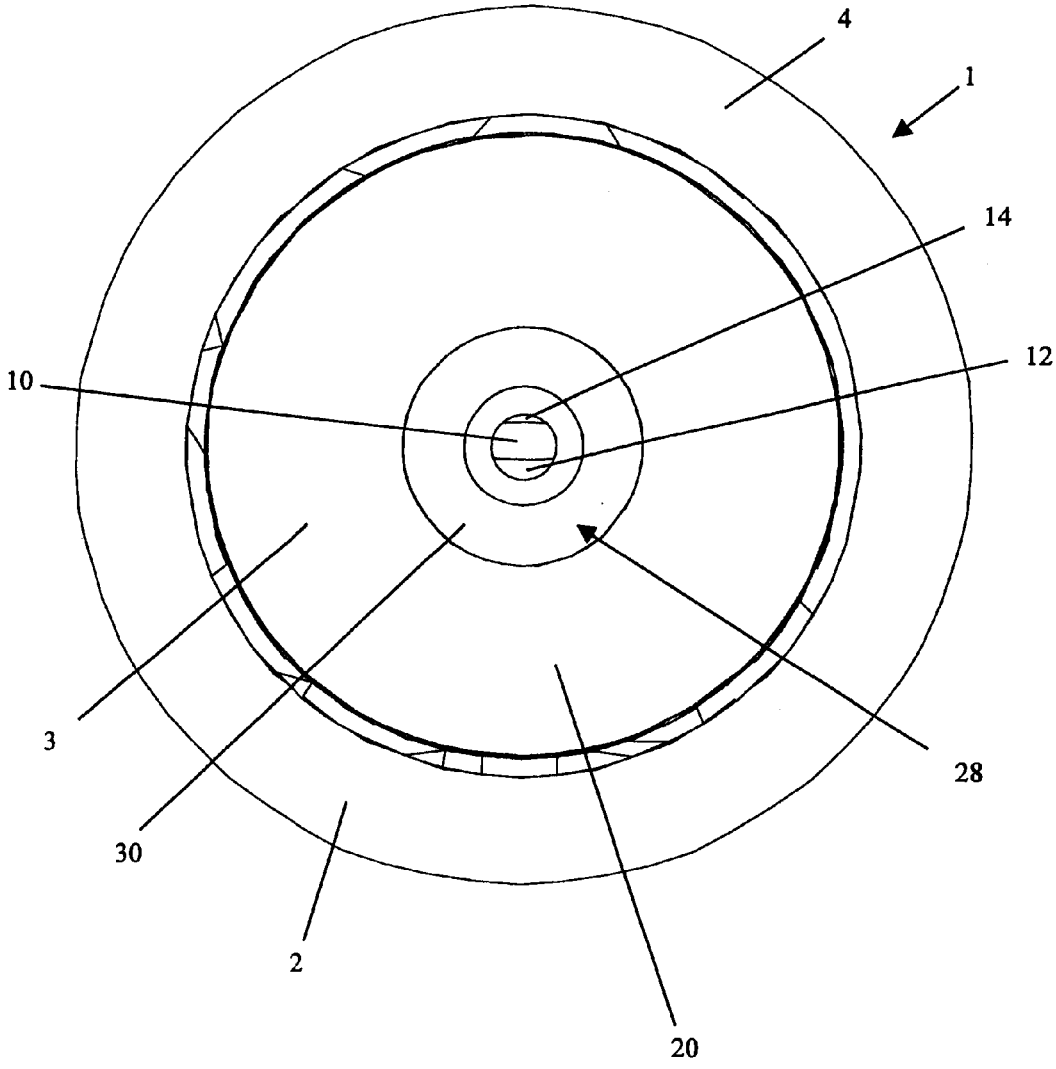
FIG. 4 is a top view of the nozzle of the present invention.
Figure 5:
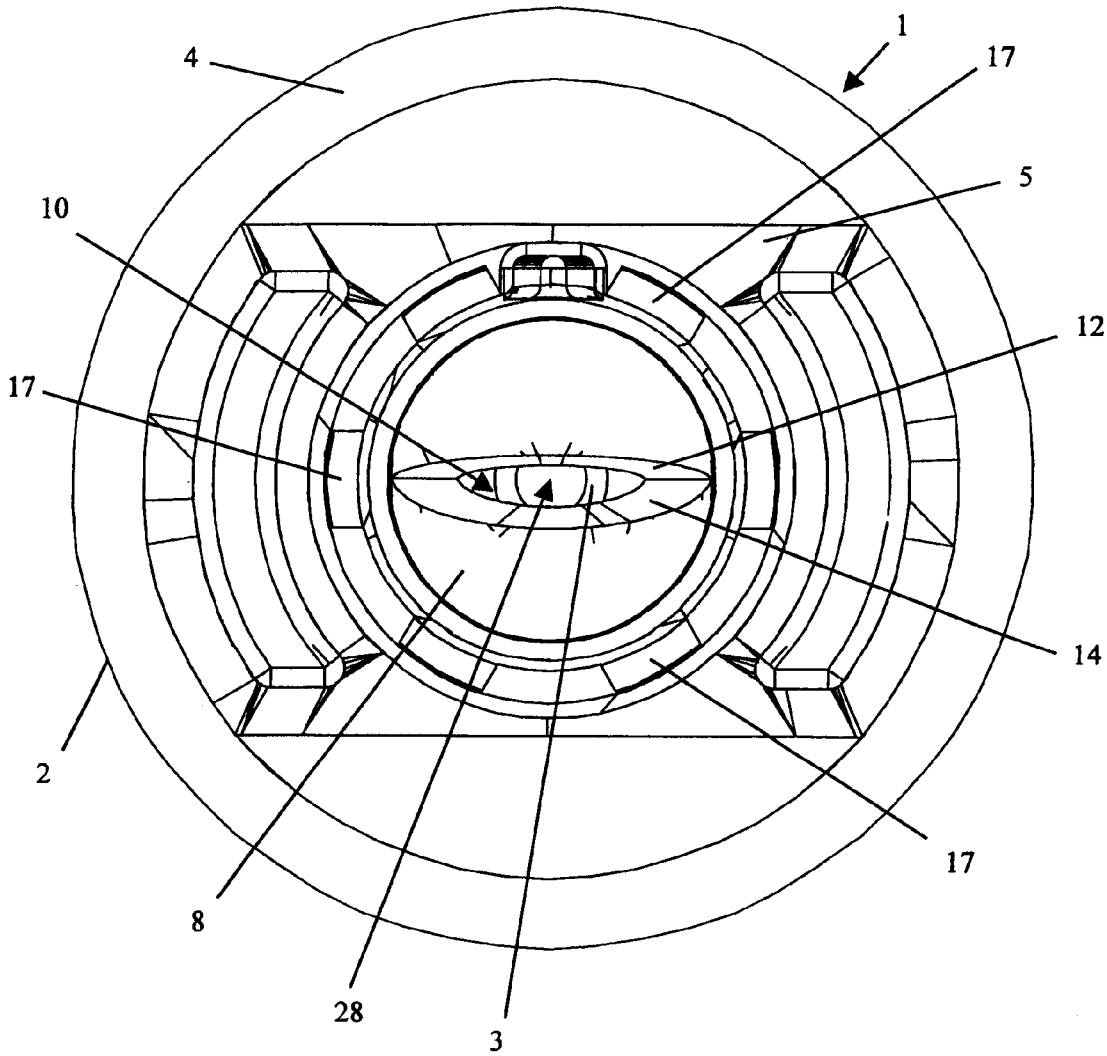
FIG. 5 is a bottom view of the nozzle of the present invention.
Figure 6:
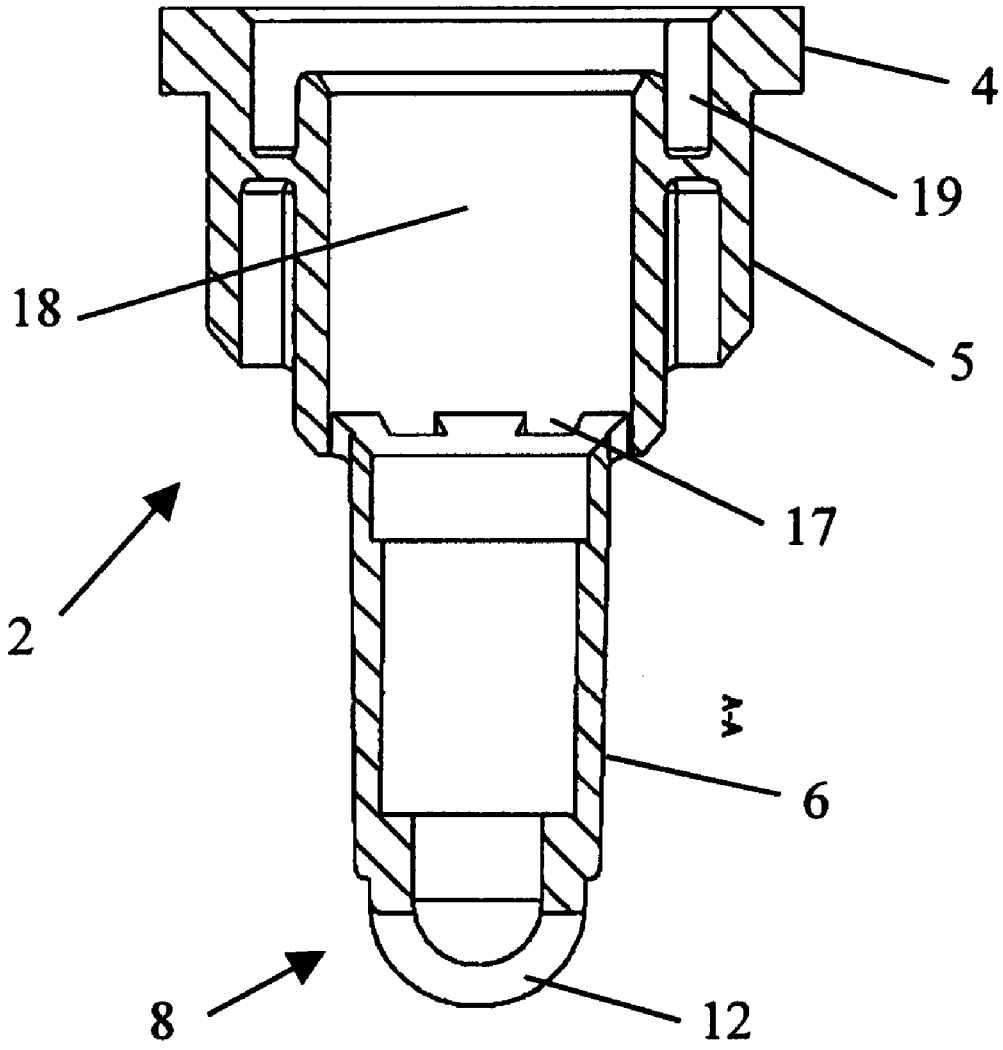
FIG. 6 is a cross-sectional view of the outer member of the nozzle of the present invention.

The nozzle 1 has an outer member 2 and an inner member 3. The nozzle 1 is designed to fit within a holder or cap (not shown) designed to receive and hold standard ISO nozzles. As such, the nozzle 1 has certain features common with other ISO nozzles.

For example, the outer member 2 has a flange 4 and a central section 5 each sized and shaped to cooperate with a standard cap design. Specifically, the central section 5 is designed to fit within an opening the cap and the flange 4 engages the surfaces of the cap to ensure the nozzle 1 remains affixed to the cap.

The nozzle 1 of the present invention, however, is very different from a standard ISO nozzle in a variety of respects. As shown in FIGS. 1–6, the outer member 2 also includes a generally cylindrical extension 6 that terminates in a semi-spherical tip 8. The tip 8 has a generally V-shaped discharge slot 10 formed by a pair of walls 12 and 14. The wall 12 is generally parallel to the longitudinally axis of the nozzle 1. The wall 14 is not parallel to this axis and, instead, extends at an angle in the range of 10° to 20° (and preferably 15°) from the longitudinal axis. To provide a clear indication of which wall is parallel and which wall is angled, an exterior projection 16 is provided. As shown, projection 16 is on the side of the parallel wall 12 and opposite that of the angled wall 14.

Another important feature of the outer member 2 is the series of openings 17 between the central section 5 and the cylindrical extension 6. The openings 17 provide a path for air to be educted into the flow stream. Also, because a plurality of smaller openings 17 are provided, as opposed to a single larger opening, the air is filtered of debris, the chance of clogging the entire area of the openings is reduced, and the air flow into the stream is more uniform.

The outer member 2 has an inner lumen 18 (see FIG. 6) which is wider in the area of the flange 4, has a smaller diameter in the area of the central section 5, and is smaller yet in the area of the extension 6. Surrounding the lumen 18 in the are of the flange 4 is a channel 19 that is used to lock the inner member 3 to the outer member 2.

Figure 7:
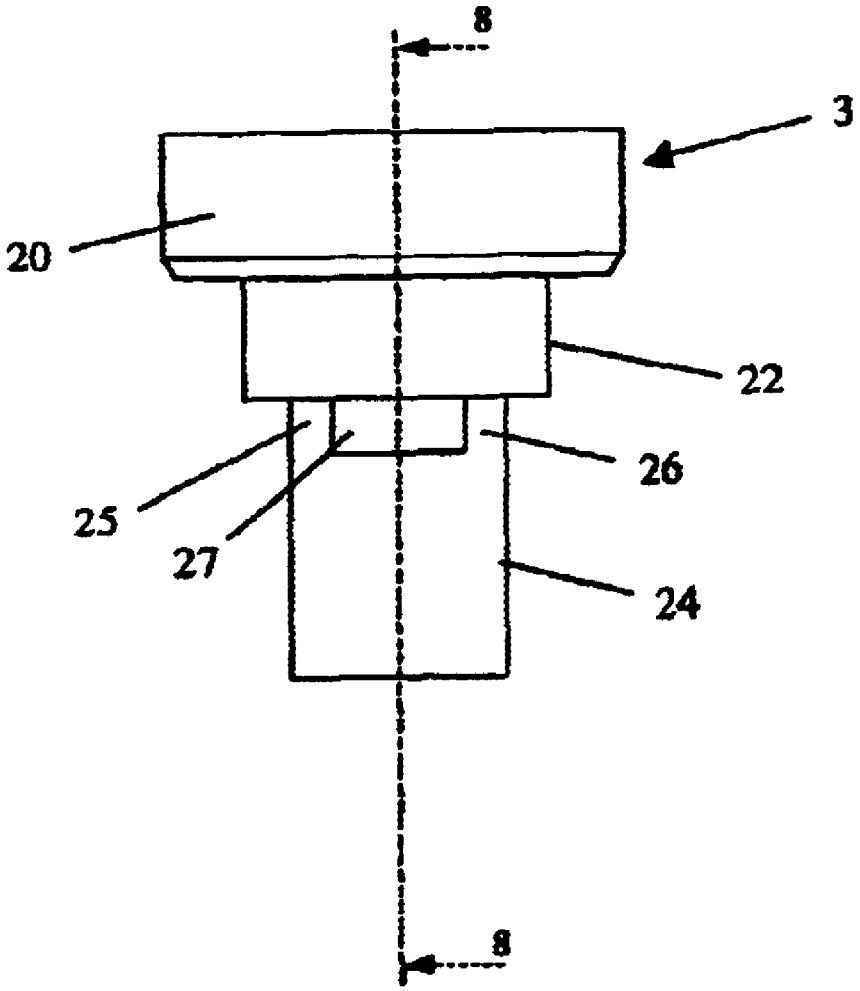
FIG. 7 is a side view of the inner member of the nozzle of the present invention.
Figure 8:
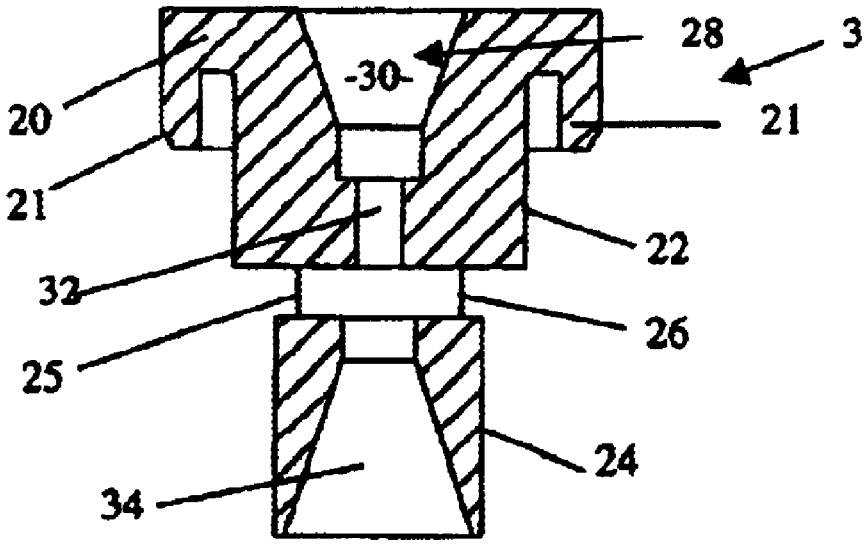
FIG. 8 is a cross-sectional view of the inner member of the nozzle of the present invention.

FIGS. 7 and 8 show the construction of the inner member 3. The inner member 3 has a flange 20 having a projection 21 that fits within the channel 19 of the outer member 2. The inner member 3 also has a central ring 22 and an extension 24. The space 27 between the extension 24 and the ring 22 is generally open. A pair of posts 25 and 26 hold the ring 22 and extension 24 in spaced apart relation.

FIG. 8 shows the shape of the lumen 28 that runs through the inner member 3. As shown, the lumen 28 has a frusto-conical portion 30 in the area of the flange 20. As it continues, it narrows to a cylindrical section 32 in the area of the ring 22. It also has a frusto-conical section 34 in the area of the extension 24.

When the inner and outer members are assembled, the end of the extension 24 of the inner member 3 resides within the extension 6 of the outer member 2. Also, a chamber is created between the outer wall of the extension 24 of the inner member 3 and the inner wall of the central section 5 of the outer member 2. This chamber, in combination with the openings 17 of the outer member 2 and the space between the ring 22 and the extension 24 of the inner member 3, creates a flow path through which air can be educted into the stream of liquid passing through the nozzle 1. That stream of liquid passes through the lumen 28 of the inner member 3, mixes with the air, passes through the extension 6 of the outer member 2 and then through the slot 10. The nature of the flow path and the shape of the slot 10 give the fluid exiting the nozzle 1 the same motion as if the boom were tipped approximately 15°.

Nozzles constructed in accordance with the preferred embodiment offer a variety of advantages. First, such nozzles eliminate the need to change the angle of the boom to ensure a comprehensive spray pattern irrespective of the height of the boom. Second, such nozzles are preset to provide the correct delivery angle for the chemicals providing improved penetration into the crop canopy so the chemicals reach weeds hiding under crop foliage. Third, the nozzles of the present invention fit standard booms and standard nozzle body holders or caps. Fourth, no tools are needed to change the nozzles. Fifth, the nozzles can be used to provide either an angled back or an angled forward delivery of chemicals and are clearly marked to assist in assembly and installation to achieve whichever type of angled delivery is required. Sixth, the design of the eduction system and the slot design permit the nozzle 1 to be used effectively at lower operating pressure to deliver a more open spray pattern. Finally, the preferred embodiment can be constructed in a variety of sizes either to fit different ISO or other sized caps or holders.

While the preferred embodiment described above shows the wall 14 angled of 15° from the longitudinal axis of the nozzle 1, the wall 14 can be set at different angles (preferably in the range of 10° to 20°) to modify the discharge pattern and impart a different spray angle. These and other changes can be made to the preferred embodiment of the invention without departing from the scope of the invention as defined by the following claims.

What is claimed:

1. A nozzle for agricultural sprayers comprising:

(a) an outer member having a flange, a central section, a cylindrical extension terminating in a semi-spherical tip, a lumen extending therethrough, and a plurality of air eduction openings, said semi-spherical tip including a discharge slot having a first wall and a second wall, said second wall positioned at an angle in a range of 10° to 20° from a longitudinal axis of said nozzle; and (b) an inner member insertable into the lumen of the outer member, said inner member having a flange, a central ring, an extension, a lumen and at least one opening which cooperates with said plurality of air eduction openings in the outer member to educt air into the lumen of the inner member when liquid passed through the lumen of the inner member, into the extension of the outer member and out the discharge slot of the semi-spherical tip of the outer member.

2. The nozzle of claim 1 wherein the angle at which said second wall is positioned is 15° from said longitudinal axis.

3. The nozzle of claim 1 wherein said opening of said inner member is located between said central ring and said extension of said inner member.

4. The nozzle of claim 1 wherein said inner member also includes a pair of posts which hold the central ring and said extension of said inner member in spaced apart relation to create said at least one opening of the inner member.

5. The nozzle of claim 1 wherein when said inner member and said outer member are assembled, a chamber is created between a portion of said inner member and a portion of said outer member, said chamber cooperating with said plurality of air eduction openings in said outer member and said at least one opening of said inner member to educt air into the liquid passing through the nozzle.

* * * * *